United States Patent [19]

Ringkamp

[11] 3,978,768

[45] Sept. 7, 1976

[54] TRANSFER FEED SYSTEM

[75] Inventor: Joseph D. Ringkamp, Clarks Summit, Pa.

[73] Assignee: Acker Drill Company, Inc., Clarks Summit, Pa.

[22] Filed: Nov. 4, 1974

[21] Appl. No.: 520,895

[52] U.S. Cl. ..... 91/189 R; 92/29; 92/66; 214/83.24; 214/518

[51] Int. Cl.[2] ..... F15B 11/18; F15B 13/07

[58] Field of Search ..... 92/66, 29; 214/83.24, 214/82, 82.3, 518; 198/221, 222; 91/189, 168

[56] References Cited

UNITED STATES PATENTS

| | | | |
|---|---|---|---|
| 2,257,324 | 9/1941 | Behm et al. | 91/168 |
| 2,397,106 | 3/1946 | Haller | 91/168 |
| 2,568,228 | 9/1951 | Forse | 91/168 |
| 3,812,766 | 5/1974 | Weiss | 92/29 |
| 3,832,937 | 9/1974 | Moore | 91/168 |

*Primary Examiner*—Paul E. Maslousky
*Attorney, Agent, or Firm*—Watson, Cole, Grindle & Watson

[57] ABSTRACT

Apparatus for transporting work over a predetermined path previously requiring a transporting mechanism of a minimal dimension with respect to the corresponding dimension of the path. A transport mechanism is provided for transporting the work over a portion of the path, which transport mechanism has a corresponding dimension substantially less than the minimal dimension. The work is initially maintained in a position in which it is propelled by the transporting mechanism. A further transporting mechanism is provided, which mechanism also has a corresponding dimension substantially less than the minimal dimension. A transfer mechanism transfers the work from a position in which it is propelled by the transport mechanism into a position in which it is propelled by the further transport mechanism. Both the transport mechanism and the further transport mechanism in at least one position are capable of an overlapping arrangement in which the total corresponding dimensions of both of the mechanisms is substantially less than the previous minimal dimension.

10 Claims, 9 Drawing Figures

TRANSFER FEED SYSTEM

BACKGROUND OF THE INVENTION

The present invention relates to a drive system for tranporting a work member over a predetermined path.

The situation often arises that due to limitations upon the available work space, the size of the mast structure holding a work member, such as a drill, can be severely limited. Such a situation can especially occur, for example, when working inside a tunnel, such as in subway construction. Additionally, for purposes of transportation, it becomes desirable to limit the size of the mast in order that the system is more easily transportable. While the desirability of condensing the size of the mast structure exists with all types of drive systems, it becomes especially significant in the utilization of hydraulic drive systems.

In the utilization of a single end hydraulic cylinder, the path of travel for the work member is basically equal to the active length of the cylinder. The overall length of the structural mast which is required however, is essentially equal to the distance of travel plus the length of the piston. While the utilization of such a single end cylinder provides for a relatively compact system, it has several drawbacks. One such drawback is that the effective force which can be supplied is significantly reduced on the rod end by the area of the rod itself. Additionally, when activating the piston end, the rod is placed in compression and for structural reasons this tends to limit the total practical length of the system.

It is alternatively possible to utilize a double end cylinder which eliminates the drawbacks associated with the use of a single end cylinder. In utilizing such a double end cylinder, however, the total length of the assembly has to be equal to two times the total path in addition to the length of the two end caps of the piston. Consequently, the utilization of such a system significantly increases the size of the necessary mast structure.

Accordingly, with any of the previously known systems, it is necessary that in order to transport a work member over a predetermined path that a certain minimal dimension in relation to the corresponding dimension of the path be utilized. In the use of a double end cylinder, as noted above, this minimal dimension is approximately two times the distance of the predetermined path. In the utilization of other drive systems however, the minimal dimension dimension would be substantially equal to the length of the predetermined path.

SUMMARY OF THE INVENTION

An object of the present invention is to provide a drive system for transporting a work member over a predetermined path in which the overall size of the system can be significantly reduced from previously known systems.

An additional object of the present invention is to provide a double end hydraulic drive system in which the overall length of the system is significantly reduced.

A further object of the present invention is to provide such a hydraulic system in which the overall length of the system is approximately one-half the length of previously known systems.

In order to accomplish these objectives, an arrangement is provided in accordance with the present invention for transporting a work member over a predetermined path such that where it was previously necessary to provide a transporting mechanism of a minimal dimension with respect to the corresponding dimension of the path, the overall length of the transporting mechanism is now substantially less.

In accordance with the present invention, a first transporting mechanism is provided for transporting work over a portion of the path, with this transporting mechanism having a corresponding dimension substantially less than the minimal dimension. The work member is initially maintained in a position in which it is propelled by this transporting mechanism. A further transporting mechanism is provided for transporting the work member over another separate portion of the predetermined path, with this further transporting mechanism also having a corresponding dimension substantially less than the minimal dimension. A transfer mechanism transfers the work from its position in which it is propelled by the transporting mechanism into a position in which it is propelled by the further transporting mechanism. The transporting mechanism and the further transporting mechanism in at least one position are capable of an overlapping arrangement in which the total corresponding dimension of both of the mechanisms is substantially less than the previously attainable minimal dimension.

The primary advantages of being able to utilize such a smaller mast are greater stability, less material required for construction, and greater maneuverability, e.g., it is possible to utilize the mast in a tunnel and still drill substantially in a vertical rather than in a horizontal direction. The savings in height of the mast by utilizing two mechanisms is generally one-half the height required for a single mechanism minus a fixed amount which is necessary for the mechanism to effect the transfer of power.

In accordance with a preferred embodiment of the present invention, the transport mechanisms each transport the work member over approximately one-half of the overall predetermined path. It is also possible for each of the transport mechanisms however, to transport the work member over a different percentage of the path, for example 60% and 40%. It is further more possible in other embodiments of the present invention to utilize three or more such transport mechanisms in which each of the mechanisms transports a work member over a separate portion of the predetermined path, each portion being substantially less than the minimal distance.

In the preferred embodiment, both of the transport mechanisms are formed by two double end hydrualic cylinders, which are arranged in a side-by-side relationship on a single mast structure. Each of these hydraulic cylinders includes a piston and a cylinder forming the chamber. The piston and cylinder are arranged such that the cylinder travels along the longitudinal axis of the piston. The work member is initially coupled to the outer extremity, i.e., the rear end, of the cylinder associated with the transport mechanism. The transport mechanism causes this cylinder to move forward along its associated piston. A transfer mechanism then transfers the work from this coupling with the cylinder of the transport mechanism into a coupling with the forward edge of the cylinder of the further transport mechanism. During a short interval of the transfer process, the work is transported by both of the cylinders. A micro-switch, which is included within the transfer mechanism, is activated when the cylinder associated with the transport mechanism is finally released so as to activate the other cylinder associated with the further transport mechanism. The transfer mechanism then completes the transfer of the work member from its coupling with the cylinder of the transport mechanism into a coupling with the forward edge of the cylinder associated with the further transport mechanism. The further transport mechanism then causes its respective cylinder to move forward along its associated piston so as to complete the movement of the work member along the predetermined path.

DESCRIPTION OF THE PREFERRED EMBODIMENTS

Figure 1:
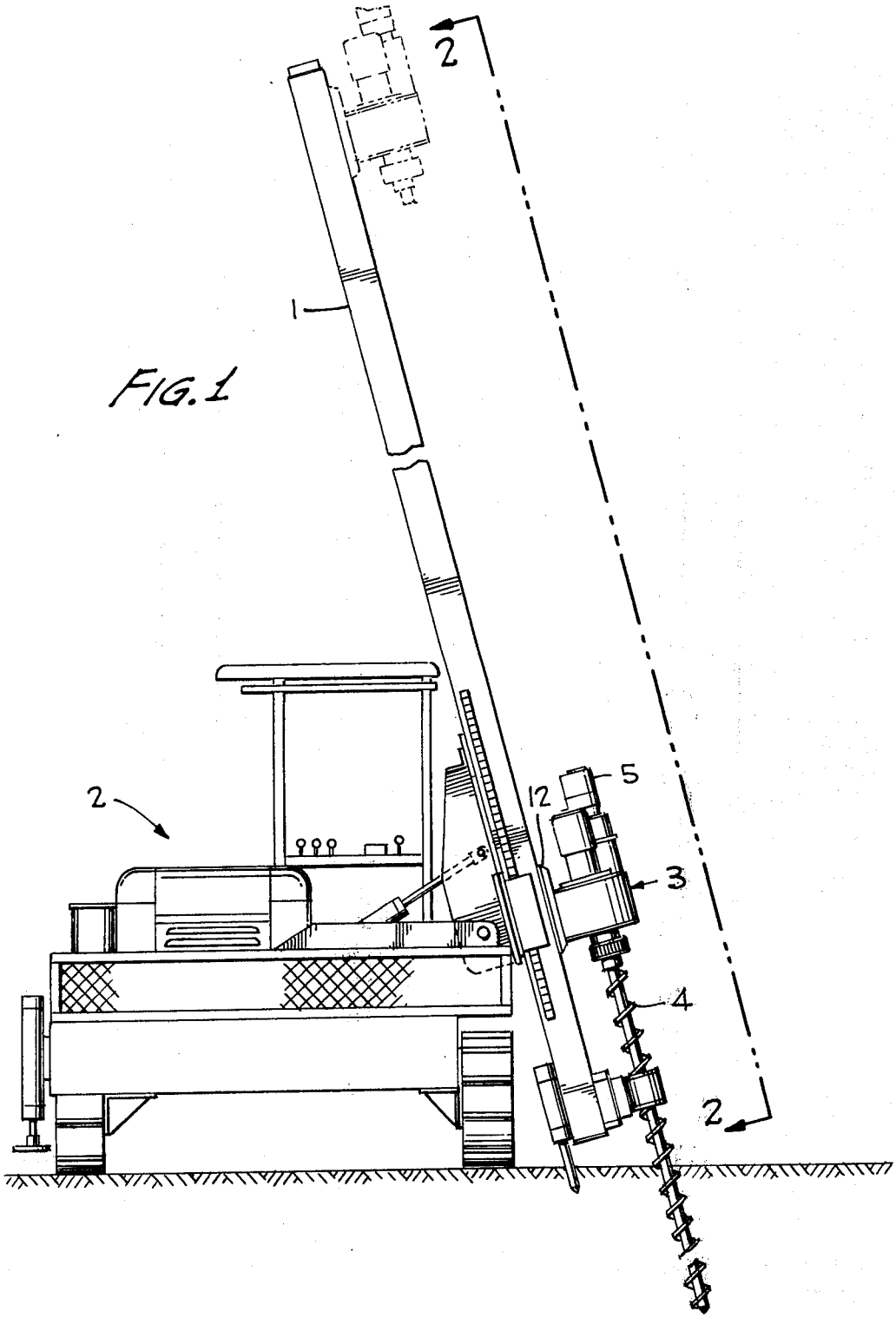
FIG. 1 is a side view of a drilling system utilizing the transport arrangement of the present invention.

As shown in FIG. 1, the drive system and work member arrangement are mounted on a mast structure 1, which in turn is mounted on a tractor 2. The work member arrangement illustrated, which is merely exemplary, includes a housing 3, a drill 4 and a drive motor 5. The housing 3 is coupled to the mast 1 via a base plate 12. The base plate 12 is movable along the longitudinal axis of the mast structure 1.

Figure 2:
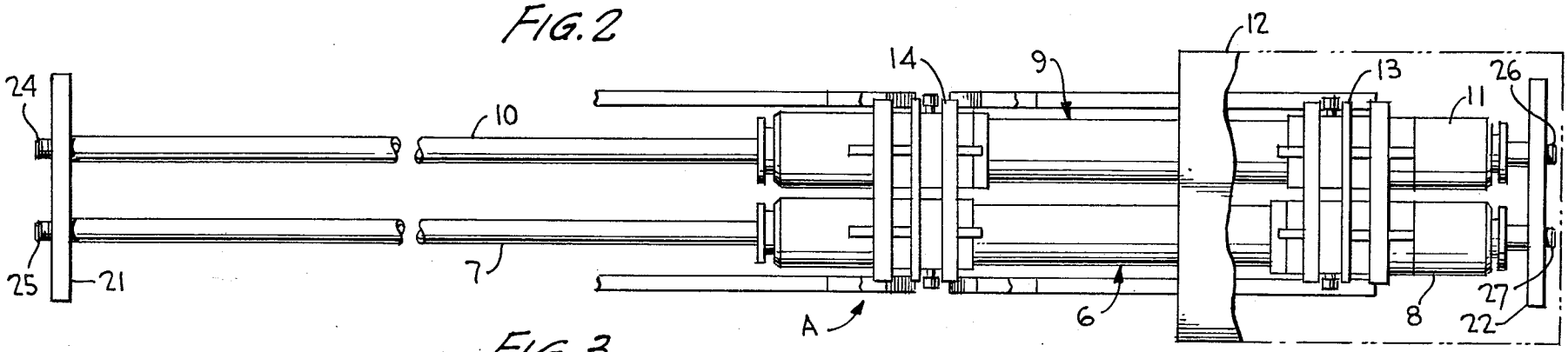
FIG. 2 is a front view of a portion of the transport arrangement illustrated in FIG. 1 along lines 2—2, with the base plate being positioned in its starting position.
Figure 3:
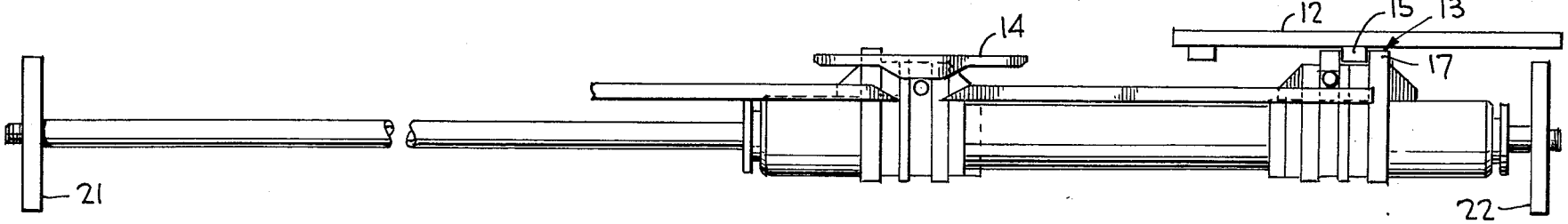
FIG. 3 is a view in the direction of arrow A illustrated in FIG. 2 with the base plate being in its starting position as in FIG. 2.
Figure 6:
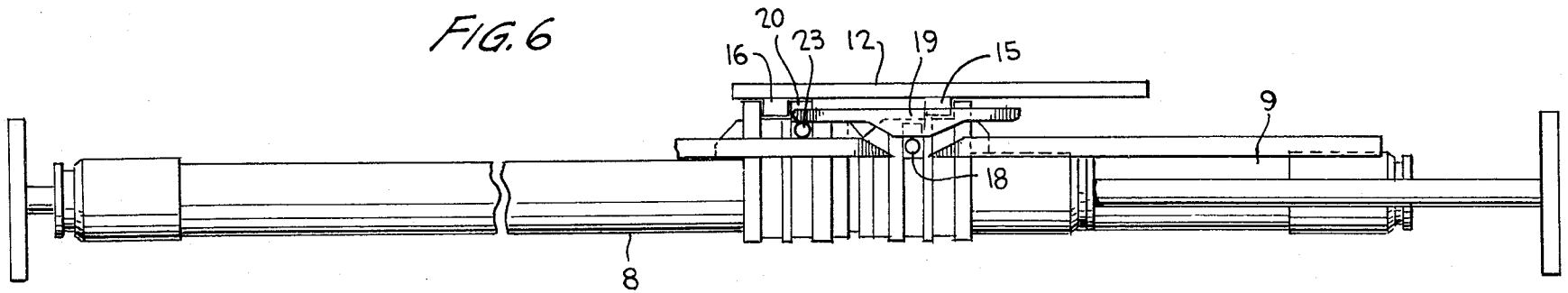
FIG. 6, which provides a view similar to FIG. 3, illustrates the position in which the transfer process has been completed.
Figure 7:
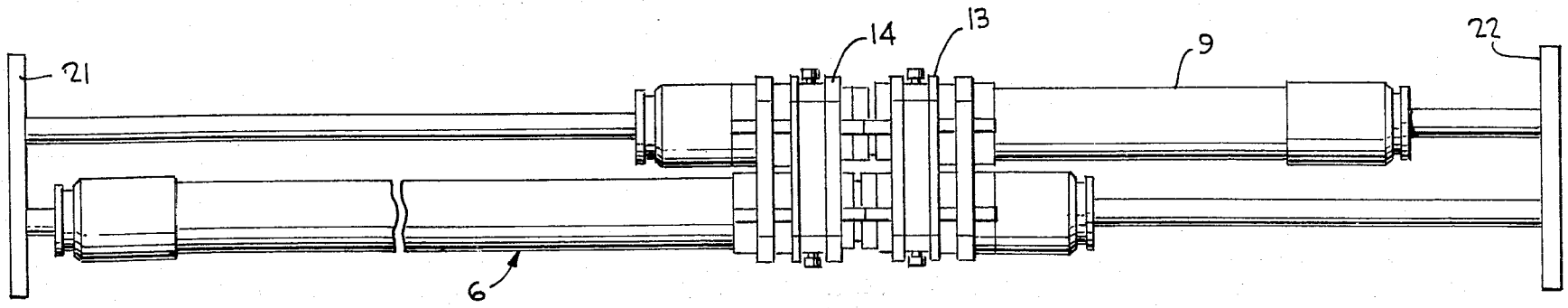
FIG. 7, which provides a view similar to FIG. 2, provides an illustration with certain elements being removed for the sake of clarity in which there is an overlapping arrangement of the cylinders during the transfer procedure.

The base plate is sequentially moved by two transport mechanisms 6 and 9, as illustrated in FIG. 2. Both of these transport mechanisms are formed by double end hydraulic cylinders arranged in a side-by-side relationship. Transport mechanism 6 includes a piston rod 7 which is longitudinally slidable within the chamber of cylinder 8. Transport mechanism 9 in turn includes a piston rod 10 which is slidable within the chamber of a cylinder 11. Base plate 12 is initially connected at the beginning of the transport procedure to transport mechanism 6 via cam arrangement 13. Cam arrangement 13 is fixed on the rear end of cylinder 8 and slides along cylinder 11. Accordingly, upon actuation of transport mechanism 6, cylinder 8 longitudinally slides along its piston rod 7 so as to move towards the forward end 21 from the rear end 22. During this movement of the base plate by transport mechanism 6, load bar 15, which projects from base plate 12 is engaged by fixed driver 17 of cam arrangement 13, as illustrated in FIG. 3. The final position of cylinder 8 after completion of this movement is illustrated in FIG. 6.

Figure 4:
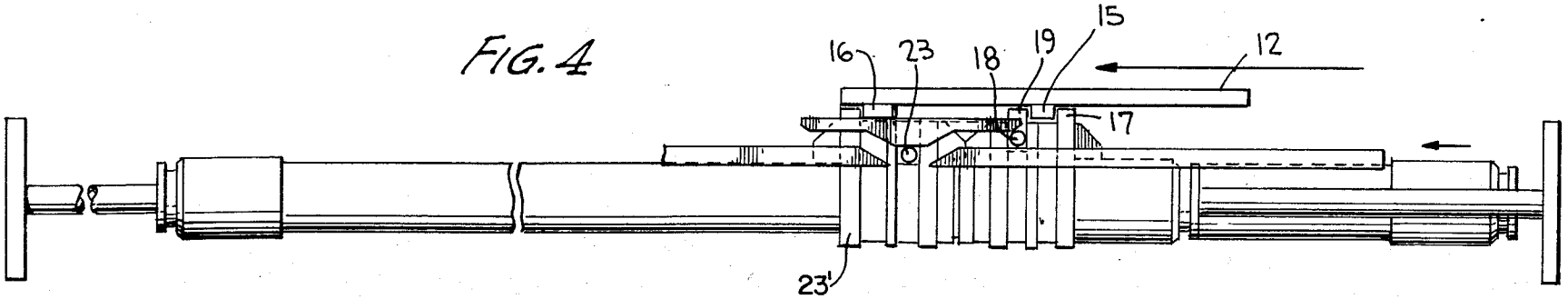
FIG. 4 illustrates a view similar to FIG. 3 with the base plate having moved to a position in which the transfer procedure is initiated.
Figure 5:
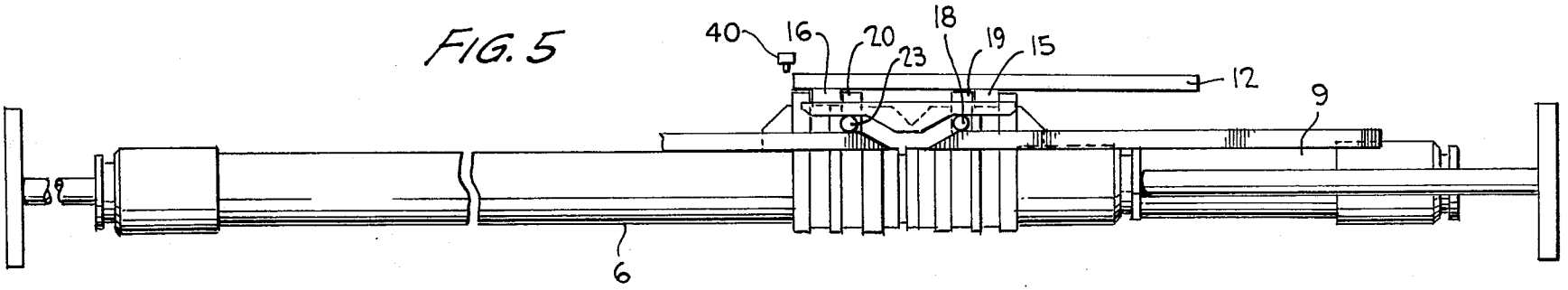
FIG. 5, which provides a view similar to FIG. 3, illustrates an overlap position of the two cylinders during which the base plate is driven by both cylinders.

A transfer of the coupling arrangement of the base plate between transport mechanism 6 and transport mechanism 9 occurs during the last few inches of the stroke of cylinder 8 such as, for example, during the last 6 inches. The various stages of this transfer procedure are illustrated in FIGS. 4, 5 and 6. Thus, at the beginning of the transfer operation, as illustrated in FIG. 4, the front surface cam arrangement 13 begins pushing on the rear surface cam arrangement 14, which is mounted on the forward end of cylinder 11. Subsequently, during the next few inches, e.g., 3 inches, of the stroke, load bar 16 pushes a cam operating member 23' thereby causing the advance of cam follower 23. In turn, cam operative driver 20, which is mounted in a position over cam follower 23 in such a manner so as to be movable in a radial direction with respect to cylinder 11, is pushed in an upward direction by the cam follower 23. When the cam driver 20 is in its raised position it engages the rear surface of load bar 16, which projects from the bottom of base plate 12. Once the cam driver 20 is in its raised position, as illustrated in FIG. 5, there is a period in which the base plate is transported by both transport mechanisms 6 and 9. Consequently, in this position there is an overlap of the operation of the transport mechanisms for a short interval, for example, an additional three inches. A micro-switch 40 is activated when the cylinder associated with the transport mechanism is finally released so as to activate the other cylinder associated with the further transport mechanism.

During the remaining portion of the stroke of cylinder 8, the cam follower 18 begins to fall thus causing the cam operated driver 19 to likewise descend. This drop in the position of the cam operated driver 19 thus causes the release of load bar 15 from cam arrangement 13, as illustrated in FIG. 6. During this disengagement of load bar 15 from the cam arrangement 13 however, continued movement of the base plate is controlled by cam arrangement 14 operating in association with transport mechanism 9.

While upon initiation of the transport procedure base plate 12 is coupled to the rear end of cylinder 8 of transport mechanism 6, during the subsequent portion of the transport of the base plate over the remaining portion of the path, the base plate is coupled to the forward end of cylinder 11 of transport mechanism 9. During the transfer of the coupling of base plate 12 from cam arrangement 13 to cam arrangement 14, the hydraulic mechanism associated with transport mechanism 6 is deenergized and the hydraulic mechanism associated with transport mechanism 9 is energized. The switch in the energization between the two hydraulic mechanisms can be provided by a micro-switch mounted on the mast structure. This micro-switch would be tripped at the end of the stroke of cylinder 8 along its respective piston rod 7. This change in energization causes a sequencing valve to switch the flow of hydraulic fluid from port 25 associated with the hydraulic cylinder of transport mechanism 6 to port 24 associated with the hydrualic cylinder of transport mechanism 9.

Figure 8:
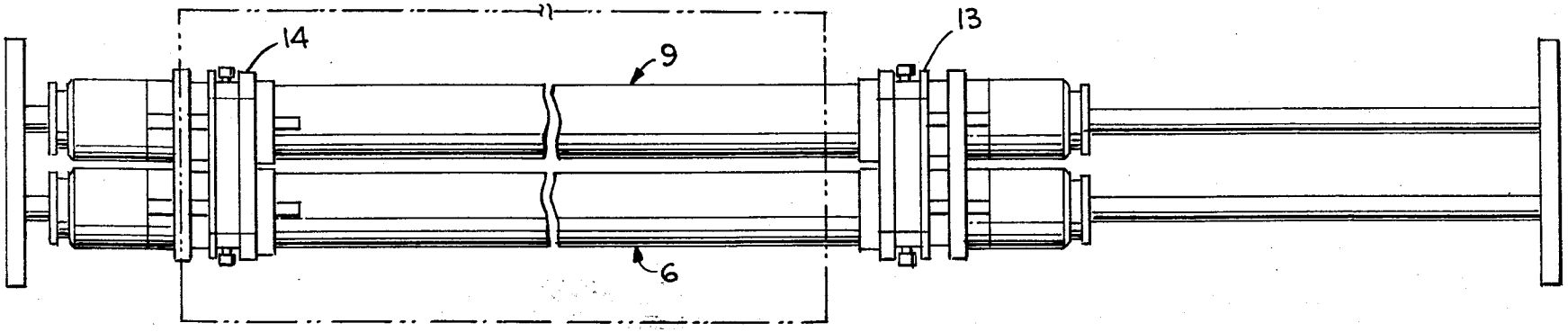
FIG. 8, which provides a view similar to FIG. 7, illustrates the cylinders in their final position after completion of the movement of the work along the predetermined path.

Cylinder 11 of transport mechanism 9 is now caused to move towards forward end 21 of the mast. Along with the movement of cylinder 11, base plate 12 is carried towards forward end 21 of the mast, until completion of the desired path of travel, as illustrated in FIG. 8.

The return of base plate 12 to its original position would be in the exact reverse procedure of the above described operation. In this reverse operation, the flow of the hydraulic fluid must be directed towards fluid ports 26 and 27.

Figure 9:
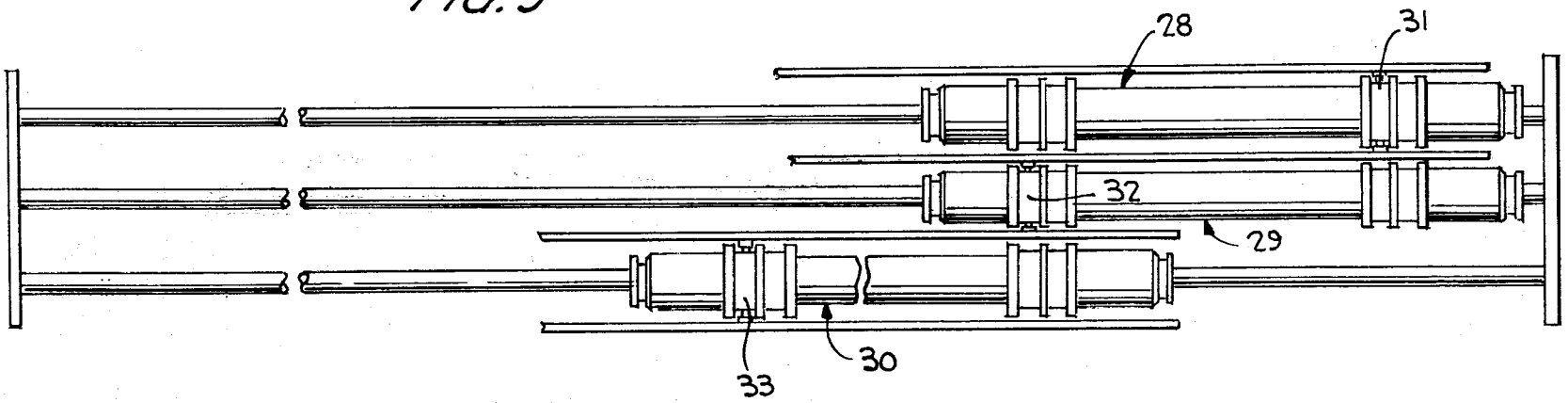
FIG. 9, which is a view similar to FIG. 2, illustrates a modified embodiment of the transport arrangement of the present invention.

As illustrated in FIG. 9, it is also possible to utilize an embodiment in which three transport mechanisms are provided. Again these transport mechanisms are double ended hydraulic cylinders which are arranged in a side-by-side relationship. The hydraulic cylinders 28, 29 and 30, along with cam arrangements 31, 32 and 33, are sequentially operated so as to move the work member from the rear end of the mast to the forward end of the mast. Such an arrangement would further decrease the overall length of the mast structure.

It is noted that the above description and the accompanying drawings are provided merely to present exemplary embodiments of the present invention and that additional modifications of these embodiments are possible within the scope of this invention and without deviating from the spirit thereof.

What I claim is:

1. Apparatus for transporting a work member over a predetermined path in such a manner as to minimize the required installation dimension of the apparatus, the apparatus comprising:

means capable of being coupled to the work member for transporting the work member over a portion of said path;

means for maintaining the work member in a coupling arrangement in which it is propelled by said transporting means;

further means capable of being coupled to the work member for transporting the work member over another portion of said path; and, means for sequentially decoupling the work member from the coupling arrangement in which it is propelled by said transporting means and transferring the work member into a coupling arrangement in which it is propelled by said further transporting means, said transporting means and said further transporting means in at least one position thereof being capable of overlapping arrangement.

2. Apparatus as defined in claim 1, wherein said transport means and said further transport means each transport the work member over approximately one-half of the predetermined path.

3. Apparatus as defined in claim 1, wherein said transport means and said further transport means are both hydraulic drive systems.

4. Apparatus as defined in claim 1, further comprising at least one additional transport means; wherein each of said transport means transports the work member over separate and substantially equal portions of the predetermined path, with a small overlap between each of said portions.

5. Apparatus as defined in claim 1, further comprising a base plate on which the work member is mounted, said base plate being sequentially coupled with said transport means and said further transport means by said transfer means.

6. Apparatus as defined in claim 5, wherein said transfer means includes cam means for transferring said base plate from a coupling with said transport means into a coupling with said further transport means.

7. Apparatus as defined in claim 1, wherein said transport means and said further transport means are formed by two double end hydraulic cylinder assemblies arranged in a side-by-side relationship.

8. Apparatus as defined in claim 7, wherein at the point of transfer by said transfer means, the work member is transported by both of said cylinder assemblies for a short interval.

9. Apparatus as defined in claim 8, wherein said transfer means includes a micro-switch which is activated when the cylinder assembly associated with said transport means is finally released so as to activate a value means for the other cylinder assembly associated with said further transport means.

10. Apparatus as defined in claim 7 wherein each hydraulic cylinder assembly includes a piston and a cylinder arranged such that said cylinder travels along the longitudinal axis of said piston;

said cylinder assemblies are mounted on a single mast structure;

said work is initially coupled to the outer extremity of said cylinder of said cylinder assembly of said transport means;

said transport means causes said respective cylinder to move forward along its associated piston;

said transfer means transfers said work from its coupling with said cylinder of said transport means into coupling with the forward edge of the cylinder of said cylinder assembly of said further transport means; and, said further transport means causes said respective cylinder to move forward along its associated piston.

* * * * *